US006921342B2

(12) United States Patent
Jong

(10) Patent No.: US 6,921,342 B2
(45) Date of Patent: Jul. 26, 2005

(54) LOW COST GOLF PRACTICE PLATFORM FOR DRIVING RANGES AND INDIVIDUALS

(75) Inventor: Chiou-muh Jong, 11058 Dorsch Farm Rd., Ellicott City, MD (US) 21042

(73) Assignee: Chiou-muh Jong, Ellicott City, MD (US)

( * ) Notice: Subject to any disclaimer, the term of this patent is extended or adjusted under 35 U.S.C. 154(b) by 0 days.

(21) Appl. No.: 10/709,185

(22) Filed: Apr. 20, 2004

(65) Prior Publication Data

US 2005/0090325 A1 Apr. 28, 2005

Related U.S. Application Data

(60) Provisional application No. 60/481,559, filed on Oct. 24, 2003.

(51) Int. Cl.[7] ..... A63B 69/36

(52) U.S. Cl. ..... 473/279; 473/278

(58) Field of Search ..... 473/266, 269, 473/270, 272, 278, 279; 248/371–398; 108/1–10

(56) References Cited

U.S. PATENT DOCUMENTS

| | | | | |
|---|---|---|---|---|
| 3,869,127 | A * | 3/1975 | Kohori | 473/279 |
| 4,279,420 | A * | 7/1981 | Bay et al. | 473/270 |
| 4,875,684 | A * | 10/1989 | Benilan | 473/279 |
| 5,431,406 | A * | 7/1995 | Ishii | 248/396 |
| 5,470,074 | A * | 11/1995 | Hotchkiss et al. | 473/279 |
| 5,820,478 | A * | 10/1998 | Wood et al. | 473/279 |
| 5,944,615 | A * | 8/1999 | Lee | 473/279 |
| 6,663,498 | B2 * | 12/2003 | Stipan | 473/279 |
| 2002/0187848 | A1 * | 12/2002 | Tomczyk | 473/279 |

* cited by examiner

*Primary Examiner*—Gregory Vidovich
*Assistant Examiner*—Nini F. Legesse

(57) ABSTRACT

A low cost, gaslift assisted golf swing platform is invented. The platform is easy to operate and capable of providing plurality of lie conditions such as uphill, downhill, sidehill up and sidehill down lies which usually are provided only by complicated inclination and rotation mechanisms in other inventions of similar purpose. The low cost golf swing platform needs no power to operate so that it is also portable to anywhere. It is easily affordable for driving range stations and individual golfers.

5 Claims, 2 Drawing Sheets

Low cost golf practice platform for driving ranges and individuals

Low cost golf practice platform for driving ranges and individuals

LOW COST GOLF PRACTICE PLATFORM FOR DRIVING RANGES AND INDIVIDUALS

BACKGROUND OF INVENTION

1. Field of Invention

The present invention relates to a golf practice device. Specifically, the present invention relates to a low cost to build golf practice device including a practice platform capable of simulating a plurality of hitting conditions.

2. State of Art

It has been always a hot topics for inventors to create good methods and practical devices to help a golfer to improve his skill in hitting ball on various fairway surfaces. To see this, all one needs to do is to search USPTO patent database, using "golf" as keyword in title field and "platform" in description field, one will find a lot of patents about platforms for improving swing on variety of hitting surfaces. For example, U.S. Published Nos. 20020187848, 20020128084, 20020119827, 20010044344, 20010034272, U.S. Pat. Nos. 6,514,152, 6,450,895, 5,944,615, 5,720,670, 5,558,334, 5,527,042, 5,470,074, 5,358,251, 5,340,111, 5,046,741, 5,005,837, 4,875,684, 4,331,332, 4,279,420, 3,693,979, 3,639,923, 3,633,918, 3,633,917, 3,430,964 and 2,937,875 published as early as 43 years ago, are all related to improving golfer's skill in hitting ball on surfaces of various inclinations. This fact reveals that golf swing is really a difficult skill to learn, it needs practice after practice to master, and that for the last forty plus years, the enthusiasm to invent an ideal device improving golf swing skill never decays.

More importantly, it reveals that an ideal device which is affordable and love to use by the individual golfers has yet to be seen in driving ranges and golfers' backyards. This is not saying that previous inventions such as those listed above are not good. Actually, if any device based on previous inventions mentioned above is available, one can really benefit by using it repeatedly and very possibly some golf schools/academies already have some such kinds in use. The problem is, we do not see these devices anywhere in the driving ranges and the reason, as quoted from paragraph 4 of U.S. Pub. No 20010,044344, "The electrical-mechanical and electrical-hydraulic platform devices are complicated and expensive to design, manufacture, sell and maintain". In fact, any customized component, not only electrical-mechanical or electrical-hydraulic one, used in the new invention is expensive to design, manufacture, sell and maintain, even the socket-ball combinations and movable supports used in U.S. Pat. No. 20010,044344 are not cheap to build either. Although it is very possible that some affluent private country clubs or golf learning schools may have expensive devices based on any of above mentioned inventions, it is yet to see them appear in the more public driving ranges and widely used by generic public golf lovers as a common practice tool.

As all kind technologies progress, the more recent inventions mentioned above have some modernized functions imbedded in the inventions, for example, Published Nos. 20010034272 has programmable memory to help learning, U.S. Pat. Nos. 5,358,251 uses pressure sensors for detecting weight distribution during golf swings. However, the central theme in all inventions mentioned above is still regarding to the creation of easy and convenient golf swinging practice platform with a plurality of lies on various inclinations. To achieve this goal, almost all designs in the inventions mentioned above have inclinable platforms such that golfer can adjust to uphill, downhill and sidehill surfaces. To make a platform inclinable, a lot of inventions mentioned above, U.S. Pat. Nos. 3,633,917, 5,340,111 and 5,358,251 to name a few, use hydraulic cylinders together with other highly customized parts to achieve the function. Some designs such as U.S. Pat. Nos. 3,430,964, 3,633,917, 4,279,420, 5,005,837 and 5,558,334 are rotatable, either with power assistance or not. Of the 25 inventions mentioned above, only 10 of them do not need electric power to operate.

The commercial driving ranges usually partition the driving area into many small swing stations. Between the stations, there is a short separation wall or other barrier to protect golfers from hurting by wild drive. On the floor of each station, typically a movable driving floor mat is sitting on the ground, with a rubber tee inserted from bottom of the mat. Some better equipped stations have power supply, some also have roofs to partially shield golfer from sunshine and rainfall. Some even have overhead hanging fans blowing heat in the winter, make stations usable all year round. Each station is about 7 to 10 foot wide. With limited space in each station, a lot of practice platforms embodied from previous mentioned inventions will not fit in such stations. Even those stations with roofs, the environment condition should still be considered as ambient, thus the platforms which are not weather resistant, especially those with complicated moving parts and control wirings will be suffering from high maintenance cost if they are installed in such stations.

The cost of using a swing station varies from around $3 to $10 per bucket of balls in the Maryland suburban area, depends on the number of balls in the bucket and driving range location. Membership subscription usually is much more affordable. Even that, the long term cost to use driving range for developing consistent golf swing is high for a normal golfer. And for this cost the golfer can only use the flat driving platform. If a driving range owner considers to invest money to upgrade some of the swing stations to be inclinable, no owner can afford a complicated, expensive and high maintenance cost inclinable platforms because then he or she needs to transfer the additional investment cost to the consumers and may not have positive impact on the business. Since most driving ranges associated with the golf courses have only roofless, no power swing stations, these golf course owners may not like any platform which requires power to operate because the cost to dig ground, bury power cables and to maintain them in the outdoor is high enough to stop them from installing such platform. This concludes that, among the 25 above mentioned inventions, 15 of those require power to operate have already been excluded out as practical platforms for the driving ranges.

Some designs, although require no power to operate, the level of customization for the components used in those designs are too high to be cost effective. These include U.S. Pat. Nos. 5,005,837, 5,046,741, 5,527,042, 6,514,152 and Pub. Nos. 20010044344, 20020187848.

Still, some designs are quite simple to build and require no power source but tedious to operate, either need manual adjustment of the threads one by one in order to change the inclination or need to lift the whole platform for making big adjustment. These designs include U.S. Pat. Nos. 3,430,964, 3,639,923, 4,279,420 and 4,331,332.

It should be pointed out that, a highly customized component is already expensive to design, manufacture and maintain, production in very limited volume make the component even more expensive. After all, a golf swing platform is used only by some specific, not even generic golfers, so the big volume production will never happen. Therefore, it is easy to see that all the complicated, multi-functional swing platforms may belong to no where, may belong only to training schools or private country clubs where some people can afford the high cost, but never belong to driving ranges where normal or weekend golfers have more limited resources to build up consistent swings.

SUMMARY OF INVENTION

The golf driving platform ideal for a driving range station is a low cost, sturdy platform which generic golfers can build up consistent swings by repeatedly using it with affordable cost in the long term. The present invention aims to such goal as an ideal device for generic golfers to use. It offers easy adjustment of downhill, uphill and sidehill lies through light manual rotation of the entire platform and less frequent, small rotational adjustment of contour driving pad relative to the platform deck. Like the gaslift in an office chair lifting the seat, the gaslift assists the golfer lifting up the entire platform off the ground for easy rotation to any preferred orientation. The golfer then can step on the platform to practice the swings at the inclination he chooses to have. By using commercially available office chair components for the rotation mechanism, the cost of manufacturing is largely reduced and can be easily affordable in the driving range installations or by personal uses. While using gaslift to lift a platform have been applied extensively to a lot of applications such as in medical devices, office chairs, petroleum automotive industries, the idea of borrowing the whole combinations of chair height adjust mechanism, gaslift and chair base together—known to be office chair mechanism as unique mechanical device to help lifting golf platform is a new way to save the cost for building a useful rotatable golf swing platform.

The present invention offers four obvious advantages. First, it is low cost to build without sacrifice much of the plurality of inclinations. Second, the components used to build this swing platform will always be available in the market since office chair manufacturing industries will always exist. Third, present invention offers absolutely secure platform because no linkages or moving parts will be in action when a golfer is swinging on the platform, and last, the platform can be easily rotated to any orientation without using electric or hydraulic power and consequently is portable to any place.

DETAILED DESCRIPTION

The objective of present invention is to provide a cost effective and sturdy golf swing practice platform without sacrificing much of the plurality of inclinations offered by previous inventions such as U.S. Pat. No. 5,340,111 which uses complicated electro-hydraulic cylinders to achieve the inclinations. Before going in depth, it is good to clarify that "rotation" refers to change orientation of the platform on X-Y plane and "inclination" refers to change angle of the platform along an axis which is horizontally pass the origin, such as X-X axis or Y-Y axis. In order to make a platform incline to all possible angles in a range between −a (below horizontal) and +a (above horizontal) degrees in all orientations, a mechanism which allows 2-D inclination along both X-X and Y-Y axes will be needed. However, if the platform can rotate 180° (not 360°, which will create half amount of redundancies), then the requirement for 2-D inclination along X-X or along Y-Y can be reduced to 1-D requirement, means that inclination along X-X or Y-Y can be dropped. Therefore, to make a platform incline to all possible angles between −a to +a degrees in all orientations, one can choose 2-D inclination, or he can replace 2-D by 1-D and make the platform rotatable for 180°.

In reality, it is much more difficult to change platform inclination angle than to change the platform orientation, especially when some heavy load is placed on the surface of the platform. This is because inclination change will involve gravitational force while orientation change has nothing to with it. For a platform to be inclination adjustable, some sort of mechanical linkage with moving parts to support the platform is unavoidable. For the platform to support a golfer not only his weight, but also the impact on the platform from his movement in golf swing, the linkage needs to be super strong to maintain stable or feels sturdy by the golfer. As a matter of fact, adjustable inclination, sturdy and low price never coexist.

Figure 1:
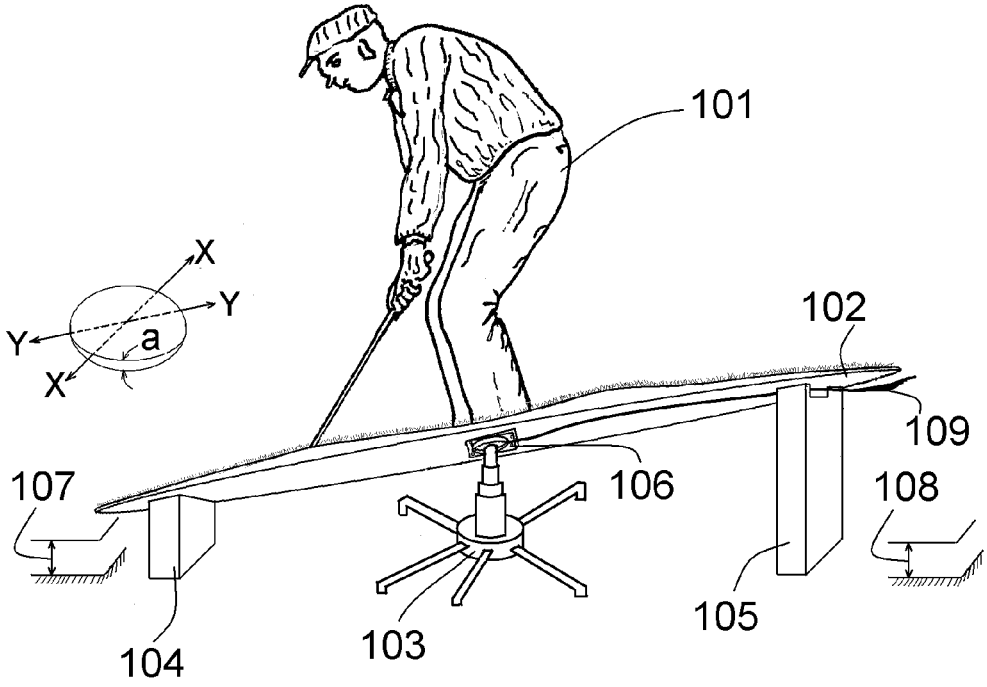
FIG. 1 shows an overview of a golfer standing on the platform ready for swing. It shows all major components in the present invention. The platform shown inclines at a fixed angle about 10° along X-X axis which points to driving direction. Platform 102 is supported by shorter leg 104 and longer leg 105 to make the fixed inclination of 10°. In this particular embodiment, the platform is lifted off the ground by manually pulling control rod 109 to unlock gaslift (also called gas spring in industry) in chair mechanism 103 to activate the assistance of the lift force exerted by the gaslift. The lifted heights 107 and 108 are high enough not to scratch the ground. The tapering block 106 is used to hold chair mechanism and the platform together.
Figure 2:
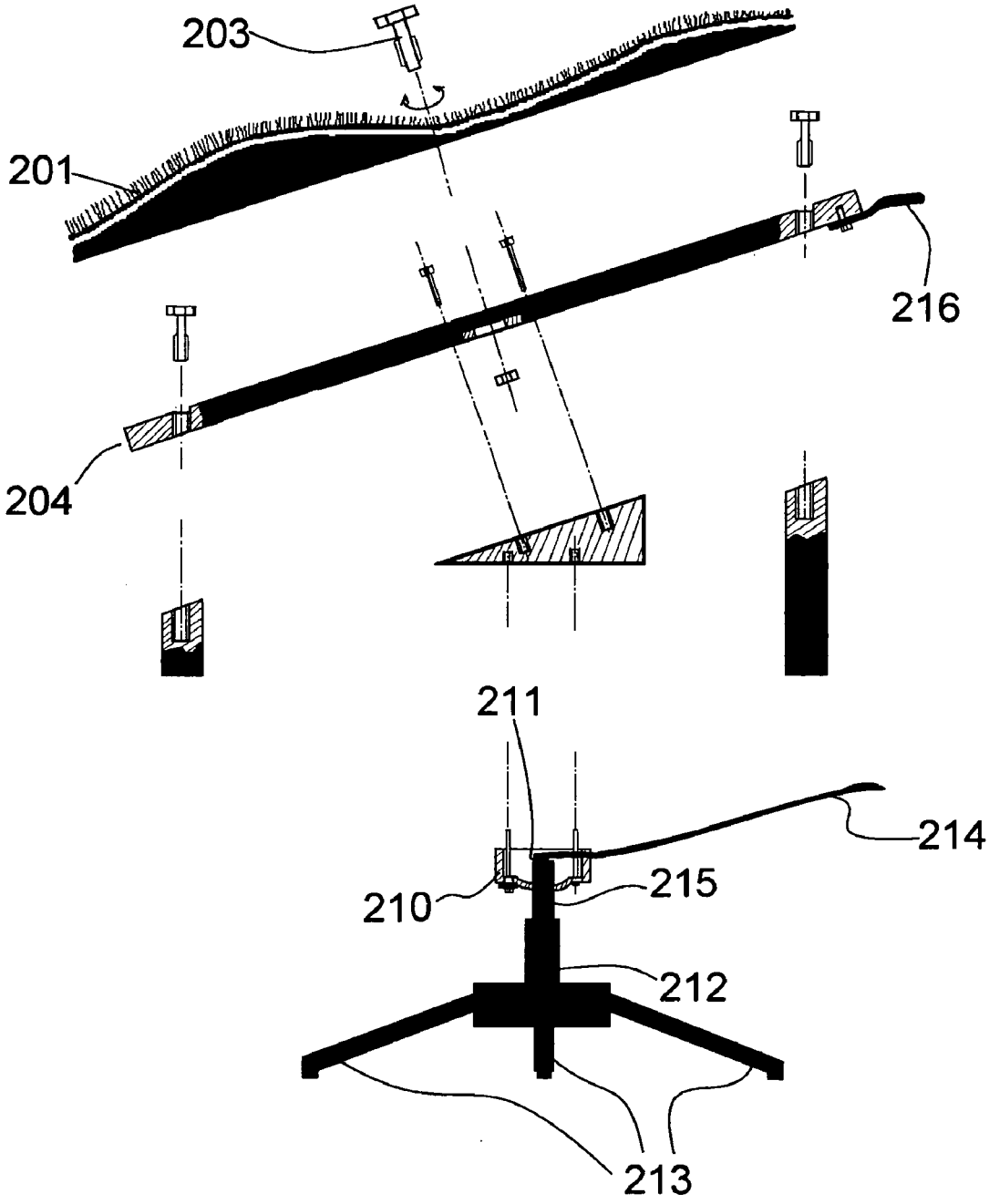
FIG. 2 shows the disassembled view of all components in details. The contour driving pad 201 is attached on the deck 204 loosely by bolt 203 such that relative rotation between contour driving pad and deck is possible to provide more choices of lies. All parts from 210 to 215 in chair mechanism are available from furniture industries as a package with the exception that control rod needs to be extended longer to the rim of the platform for easy access. The fixture 210 connects chair mechanism and the tapering block 209 and is also used as a hinge for the movements of control rod 214. The tapering block 106 shown in FIG. 1 is solely used to provide a horizontal surface for connecting fixture 210. Plunger 215 of the gaslift has a lock button 211 which locks the plunger from extension or compression. Extension or compression movement of gaslift is possible only when lock button 211 is depressed by pulling control rod 214 upward. The rotation of platform is the motion of all parts from plunger 215 and above, including deck assembly and tapering block, relative to master cylinder 212 and base 213. The handle 216 is used to make manual rotation easier by a single hand and is not a necessary part if the control rod 214 is strong enough to be also used as a handle.

In present invention, the platform is designed to rotate 360° to provide downhill, uphill, and sidehill down, sidehill up lie conditions. This means the inclination 2-D inclination is not necessary, but 1-D inclination still needs. To totally avoid using inclination mechanism, present invention makes the platform incline at a fixed angle between 5° and 20° while introducing a rotationally adjustable contour driving pad to compensate the loss of plurality of inclinations due to fixed angle inclination. For any orientation the platform is rotated to, the hilly surface of the contour driving pad will actually provide much more inclination conditions in addition to inclination from the fixed angle of the deck. Referring to FIG. 2, the location at turf 201 has an upward slope such that the lie on this particular point tilts more than the inclination of the deck. In a particular embodiment wherein the deck is inclined at 10°, the golfer who orientates the platform to swing a downhill lie as shown in FIG. 1 can apparently have a lie tilted more than 10° or less than 10° by moving the ball around. Actually, he will have much more choices of lies when he steps down the ground and rotate the contour driving pad by some angles.

In present invention, the practice platform is capable of rotating 360°, not just 180°. But as mentioned before, if 1-D inclination is available, then 180° rotation will be enough. However, one should note that 1-D inclination together with a full circle revolution will produce half of available inclinations redundant as mentioned before, unless the deck is cut in half to become a semicircular deck. In other words, when the 1-D inclination ability is removed, while the rotation ability is increased from half circle to full circle, the plurality of lies lost by removing 1-D inclination is not as severe as it sounds. This happens because when a platform is rotated, lower semicircular part of the deck rotated as well as upper semicircle part. Since both the deck and contour driving pad are fully circular, a 360° rotation of entire platform and relative rotation of contour driving pad to the deck will create most of the lies available in a 2-D inclination environment or 1-D inclination with 180° rotation environment. Consequently the need to use any mechanism for changing inclinations is eliminated without loss much plurality of inclined lies.

Referring back to FIG. 1, two legs 104 and 105 of unequal lengths are used to maintain the deck inclined at 10° in this particular embodiment. 10° is chosen because of the fact that very few locations in a golf course have lies slope more than 20°. Since the contour driving pad can be used to increase or decrease the lie inclinations, the middle value between 0° and 20°, or 10° is chosen.

Now the movement of the entire platform to adjust for different lie conditions has been simplified down to two rotations. The first one is the rotation of the entire platform along the vertical axis and second is the rotation of contour driving pad along axis perpendicular to the inclined deck. The mechanism to provide second rotation is very easy, because it is a very slow and relatively small angle adjustment, a centrally located screw like the part 203 shown in FIG. 2 which lock the contour driving pad loosely on the deck will be enough.

There are a lot of possible designs which can provide the rotation of the entire platform and may vary from very convenient to very tedious. Tedious design tends to lower the enthusiasm of practicing and therefore is not suitable for golf swing platform. Very convenient design such as using controllable actuators to lift up the platform and step motor to make controllable rotation, on the other hand, is not cost effective. A cost effective way to have rotation mechanism by present invention is to use market available office chair mechanism. By using such mechanism, the gaslift provides assistance for platform user to lift up and rotate the platform easily. To change the orientation of the platform for a new lie condition, all one needs to do is stepping down to the ground, lightly pulling up the handle 109 as shown in FIG. 1 to unlock the gaslift such that the gaslift in the office chair mechanism can lift the deck assembly off the ground, then rotate the platform to any orientation desired. The user can then pull handle 109 again and hold up it, unlock the gaslift, to lower the platform down to ground by user's weight while stepping one foot on the platform. As compared to the platform in U.S. Pat. No. 5,340,111 which has foot switches to control the inclinations and rotations of the platform, it is a little more tedious because the user needs to step out of the platform to rotate the platform. But if one compares it to other previous inventions without using power, such as U.S. Pat. Nos. 3,430,964, 3,639,923 and 6,450,895 which need manually turning the screws of every leg to adjust the inclinations, U.S. Pat. No. 4,331,332 which needs manually adding or removing blocks to change inclinations, Pub. No. 20010044344 which needs to change the socket combinations for different inclinations, present invention offers much less effort to change the swing inclinations. In conclusion, although present invention requires step up and step down to change swing inclinations and is a little more tedious than those power control mechanisms to operate, but it is much less tedious than all others using no power. It is safe to say that present invention has the simplest and easiest rotation mechanism without using power so far.

There are many advantages to use chair mechanism over other possible designs. First, chair mechanism comes with whole package, no need to redesign all components for the functions of rotation, lift, support and fixture connecting to deck assembly. It is very fortunate that whole package, including chair base, gaslift and the fixture, can all be borrowed and directly used, with only one minor alteration-extending the length of the control rod to be long enough to reach rim of the deck, for easy access to the locking or unlocking the gaslift. It is also fortunate that the gaslift in a popular office chair has a lift force around 300 to 500 newtons, or equivalent to lift around 30 to 50 kilograms (66 to 110 pounds) which is a very convenient range for designing the deck assembly to be lifted. If a poly wood board of 5 feet in diameter (needs to cut and combine from 4'×8' board) and 3 quarter inches in thickness is used as a deck, then it weighs roughly about 40 pounds. With legs and contour driving pad (roughly 35 pounds if a commercial one inch thick driving mat is used) all together, the weight of deck assembly will be easily adjusted to be in the range between 85 and 95 pounds. The height of the unexpanded chair mechanism, which is a critical value in determining the height of the deck in general, also fortunately happens to be right for this application, although a little lower will be even better. A typical chair assembly has a height (gaslift compressed to shortest length and without the casters) from 9.5 inches to 12 inches, depend on the shape of the base and other factors. A 10 inch height mechanism will support the deck assembly to have the lower end of the deck of a height about 4 to 6 inches, depends on the inclination of the deck, is just the right height for a golfer to step on the platform. All together, it is hard to imagine there is any other commercially available component package is more suitable to be used for the rotation mechanism of a platform than the chair mechanism.

Second and also an obvious advantage is the availability of parts. Availability is important because it is a measure of three factors such as abundance in the market, price and long term supply of components from supporting industries. In addition, if a component is already available in the market, there is no need to redesign. The components shown in FIG. 2, from part 210 through 215 are all available in the market with very affordable price. To see how affordable they are, one can figure out from the price of an office chair from store such as Staples, Inc. (Headquarter in Framingham, Mass.) which sold whole office chair includes all chair mechanism components for less than $40 in August 2003. Of course, if one just buys chair mechanism in volume without other chair parts not used in present invention, it will cost much less and no question that they are extremely affordable. Because the manufacturers for office chair will exist in the foreseeable future, the availability of chair mechanism will always be very high.

The third advantage is that when the platform is sitting on the ground ready for practice, the rotation mechanism is temporarily redundant to the deck assembly such that the deck assembly acts like an independent rigid platform. There is no movable linkage in stress during golf swing, a guaranteed stable swing condition. This is a big advantage over some inventions such as U.S. Pat. Nos. 4,875,684, 5,005,837, 5,340,111, 5,470,074, 6,514,150, Pub. No. 20010034272 and 20020119827, all of them require strong linkage or very difficult to make them self stable during golf swing.

Yet another advantage the present invention has is it's portability. The platform can be easily moved by the user alone to any place such as backyard with a net to catch the ball.

It is possible to replace the gaslift by the mechanical compression spring. But gaslift offers much better characteristics in that it provides an almost constant lift and compression forces throughout the whole stroke. This is a well known advantage of using gaslift over mechanical springs. Embodiment of present invention in particular, has a very limited space for rotation mechanism, a mechanical spring will not provide good lift characteristic as gaslift does.

The contour driving pad can be assembled as two parts. The first part is a circular plate from light material such as a thin wood plate with some wooden blocks cut to have bell shapes glued on the top of the plate. Second part is a commercial golf driving mat, usually one inch thick, laid on the top of first part to form uneven hitting surface similar to the fairway in a golf course. To get more variations for lie condition, one can have multiple sets of different contour driving pads with different patterns of contour and use them alternatively when needed.

For the convenience to have ball supply during golf swings, a simple ball container such as a metal wire frame basket which stands taller than highest point of the platform can be used. This may not be as convenient as some of the previous inventions which equip with automatic ball handler to supply ball one by one automatically, it should still be tolerable judging from the fact that no power source is intended to be used. Actually, a game highly involved in mental strength as golf is, it is good to have a short time period to ponder a little bit about how last swing was and how next swing will be before starting every golf swing, the action to get a ball basket and put on a favorite location on the platform for next swing offers just enough amount of time to do so. Too often over convenience makes a person acts, not only swings golf, without thinking and consequently does not offer as much learning as acting slowly, one at a time strategy.

In a driving range, a coin operated meter can be installed along with the swing platform to collect usage fee for each platform. The outdoor parking meter may be a best choice since the operating time can be set according to the coins deposited into the meter, needs no power to operate, weather resistant and costs reasonably because it is widely used by many local governments. Other possible methods to charge platform usage fee include using buckets of specific color to indicate authorization of using platform. The golfer will be given a bucket of such color (as a differentiation to other flat mat users) for filling balls and give bucket back to managers when finishing swings. This is a less cost, easier way to implement, but requires more man power to operate.

While present invention has been shown, described and illustrated in detail for illustrative purpose, it should be understood by those skilled in the art that equivalent changes in form and detail may be made therein without departing from the true spirit and scope of the invention as disclosed in the accompanying claims.

I claim:

1. A gaslift assisted golf practice platform comprising: a deck of flat circular configuration strong enough to support a golfer; a layer of light material mounted on the top of said deck, said layer of light material is circular configuration, same diameter as said deck and uneven in thickness which simulates the uneven contour of fairways in a golf course; a group of legs of unequal lengths attached to bottom surface of said deck to support said golf swing practice platform such that said deck inclines an angle preferably between 5° and 20° relative to horizontal surface; said layer of light material together with said deck and said group of legs form a deck assembly; an office chair mechanism to assist lifting said deck assembly for manual rotation of said deck assembly at any angle between 0° and 360° to give a plurality of downhill, uphill, sidehill up and sidehill down inclinations; and a tapering block with a wedge angle equal to inclination angle of said deck for connecting said deck assembly and said office chair mechanism.

2. A gaslift assisted golf practice platform according to claim 1, wherein said office chair mechanism comprising: a gaslift which further comprises a master cylinder and a plunger; a base with a center hole wherein said master cylinder of said gaslift is securely uprightly inserted; and a fixture for assembling said plunger and said tapering block together.

3. A gaslift assisted golf practice platform according to claim 2, wherein said deck assembly further comprises a handle for manually pulling said deck assembly off ground with assistance from lift force of said gaslift.

4. Gaslift assisted golf practice platform according to claim 1, wherein said deck assembly further comprises an artificial turf golf driving mat on the top of said layer of light material of uneven thickness, Said artificial turf golf driving mat together with said layer of light material of uneven thickness form a contour driving pad centrally and loosely attached to said deck by a screw.

5. A gaslift assisted golf practice platform according to claim 4, wherein said contour driving pad can be rotationally adjusted relative to said deck to provide additional combinations of plurality of inclinations in addition to the rotation of entire platform.

* * * * *